US009856881B2

(12) United States Patent
Park

(10) Patent No.: US 9,856,881 B2
(45) Date of Patent: Jan. 2, 2018

(54) DAMPER-INTEGRATED BLOWER HAVING IMPROVED AIRTIGHTNESS

(71) Applicant: CENDORI CO., LTD., Mokpo-si, Jeollanam-do (KR)

(72) Inventor: Mun Su Park, Gwangju (KR)

(73) Assignee: CENDORI CO., LTD., Jeollanam-do (KR)

( * ) Notice: Subject to any disclaimer, the term of this patent is extended or adjusted under 35 U.S.C. 154(b) by 250 days.

(21) Appl. No.: 14/785,240

(22) PCT Filed: Apr. 22, 2014

(86) PCT No.: PCT/KR2014/003495
§ 371 (c)(1),
(2) Date: Oct. 16, 2015

(87) PCT Pub. No.: WO2014/175629
PCT Pub. Date: Oct. 30, 2014

(65) Prior Publication Data

US 2016/0115965 A1 Apr. 28, 2016

(30) Foreign Application Priority Data

Apr. 25, 2013 (KR) ..... 10-2013-0046093

(51) Int. Cl.
*F04D 25/14* (2006.01)
*F04D 29/42* (2006.01)
(Continued)

(52) U.S. Cl.
CPC ..... *F04D 25/14* (2013.01); *F04D 29/4206* (2013.01); *F04D 29/4226* (2013.01);
(Continued)

(58) Field of Classification Search
CPC ..... F04D 25/14; F04D 29/4226; F24F 13/10; F24F 13/14; F24F 13/1406
(Continued)

(56) References Cited

U.S. PATENT DOCUMENTS 2,548,607 A * 4/1951 Jenn ..... F04D 25/14 454/350
6,899,516 B2 * 5/2005 Wang ..... F04D 25/14 415/121.2
(Continued)

FOREIGN PATENT DOCUMENTS

CN 101285477 * 12/2010 ..... F04D 25/14
FR 2757576 A1 * 6/1998 ..... F04D 29/4226
(Continued)

OTHER PUBLICATIONS

JP04208347—Translation from Espacenet.*
FR2757576—Translation from Espacenet.*
CN101285477—Translation from Espacenet.*

*Primary Examiner* — Woody Lee, Jr.
*Assistant Examiner* — Behnoush Haghighian
(74) *Attorney, Agent, or Firm* — Novick, Kim & Lee, PLLC; Jae Youn Kim

(57) ABSTRACT

The present invention relates to a damper-integrated blower having improved airtightness, which comprises a blower casing a having a suction port and a blower casing b fastened to the casing a from the opposite side; a vane stopper protrusion is formed on bottom surface of the exhaust port, and a vane contact housing part is formed above the exhaust port; damper motor screw fixing parts integrally protrude from the outer upper surface of the vane contact housing part of the blower casing a; a damper motor shaft hole is bored in a damper motor shaft hole protrusion part which is integrally formed on the outer upper side of the vane contact housing part of the blower casing a; a vane rotation shaft
(Continued)

protrudes from the inner surface of a damper motor shaft hole protrusion part of the blower casing b facing the damper motor shaft hole protrusion part; an eccentric damper motor shaft of a damper motor is introduced into the damper motor shaft hole so as to connect with the blower casing a; a vane as a single member is connected to the damper motor shaft and the vane rotation shaft so as to open and close the exhaust port; and a gasket is coupled to the four edges of the vane providing a vane module.

3 Claims, 5 Drawing Sheets

(51) Int. Cl.

| | |
|---|---|
| ***F04D 29/46*** | (2006.01) |
| ***F04D 29/64*** | (2006.01) |
| ***F24F 7/06*** | (2006.01) |
| ***F04D 29/62*** | (2006.01) |
| *F24F 13/14* | (2006.01) |
| *F24F 13/10* | (2006.01) |

(52) U.S. Cl.
CPC ..... *F04D 29/464* (2013.01); *F04D 29/626* (2013.01); *F04D 29/646* (2013.01); *F24F 7/065* (2013.01); *F24F 13/1406* (2013.01); *F24F 13/10* (2013.01); *F24F 13/14* (2013.01)

(58) Field of Classification Search
USPC ..... 454/353, 347, 208, 256, 338
See application file for complete search history.

(56) References Cited

U.S. PATENT DOCUMENTS

| | | | | |
|---|---|---|---|---|
| 7,329,089 | B2 * | 2/2008 | Senba | F04D 29/4206 415/146 |
| 7,529,088 | B2 * | 5/2009 | Chiu | F04D 29/161 361/694 |
| 8,197,193 | B2 * | 6/2012 | Messmer | F04D 29/4226 415/126 |
| 8,366,417 | B2 * | 2/2013 | Fan | F04D 25/14 415/220 |
| 2015/0159673 | A1 * | 6/2015 | Chang | F04D 29/522 415/200 |
| 2016/0258438 | A1 * | 9/2016 | Johnson | F04D 15/0027 |

FOREIGN PATENT DOCUMENTS

| | | | | |
|---|---|---|---|---|
| JP | 04208347 | A | * | 7/1992 |
| KR | 1990-0006691 | Y1 | | 2/1990 |
| KR | 20-1998-0028857 | U | | 8/1998 |
| KR | 20-0353379 | Y1 | | 6/2004 |
| KR | 20-0424420 | Y1 | | 8/2006 |
| KR | 10-2007-0015263 | A | | 2/2007 |
| KR | 10-2007-0016235 | A | | 2/2007 |
| KR | 20-0442683 | Y1 | | 12/2008 |
| KR | 10-2012-0101811 | A | | 9/2012 |
| KR | 10-1236422 | B1 | | 2/2013 |

* cited by examiner

DAMPER-INTEGRATED BLOWER HAVING IMPROVED AIRTIGHTNESS

TECHNICAL FIELD

The present invention relates to a damper-integrated blower that is applied to cut off the air introduced into a heat recovery ventilator, and more particularly, to a damper-integrated blower having improved airtightness that is capable of performing a ventilating operation, through which fresh outdoor air is moved into indoor air, while keeping the heat energy of the indoor air.

BACKGROUND ART

So as to improve the quality of indoor air, generally, deodorization or dust collection is conducted by means of negative ion air purifiers or electric dust collectors, and recently, heat recovery ventilators, which serve as indoor and outdoor air ventilation systems allowing for the loss of indoor heat energy, have been introduced. The heat recovery ventilators are classified into duct type ceiling mounted ventilators, ductless floor mounted ventilators, and window mounted ventilators.

Among them, the duct type ceiling mounted heat recovery ventilators cause large amount of fan motor power consumption due to the generation of static pressure from the duct and need a relatively high installation cost. Accordingly, compact and slim type heat recovery ventilators, which can be installed on windows or window frames, have been recently proposed. The heat recovery ventilator largely includes a total heat exchange element for exchanging the total heat between indoor air and outdoor air and supply and exhaust means like an exhaust blower for exhausting the indoor air and a supply blower for supplying the outdoor air. In this case, a blower type supply and exhaust means having low noise is generally adopted in the compact and slim type heat recovery ventilator.

When the heat recovery ventilator does not operate, by the way, a damper is generally mounted on the supply and exhaust grills to block the indoor and outdoor air, and in this case, it is actually hard to apply the damper to the compact and slim type heat recovery ventilators.

PRIOR ART DOCUMENTS (First Patent Document) KR 20-0424420 Y1 (2006.08.14)

(Second Patent Document) KR 20-0353379 Y1 (2004.06.03)

(Third Patent Document) KR 20-0054122 Y1 (1991.01.28)

(Fourth Patent Document) KR 20-0442683 Y1 (2008.11.25)

(Fifth Patent Document) KR 10-1236422 B1 (2013.02.18)

DISCLOSURE

Technical Problem

Accordingly, the present invention has been made in view of the above-mentioned problems occurring in the prior art, and it is an object of the present invention to provide a damper-integrated blower having improved airtightness that is capable of performing a ventilating operation, through which fresh outdoor air is moved into indoor air, while keeping the heat energy of the indoor air, and that is improved in a damper blower as disclosed in Korean Patent No. 10-123622 filed by the same applicant as the invention, which is applied to a compact and slim type heat recovery ventilator having the installation space on a window or window frame so as to block the air introduced thereinto, the conventional damper blower having a damper module formed of a plurality of vanes laid on each other in such a manner as to be open and closed.

It is another object of the present invention to provide a damper-integrated blower having improved airtightness that is capable of solving conventional problems, such as the reduction of airtightness in gaskets laid on each other if foreign materials and dust are accumulated on the gaskets of the plurality of vanes, the generation of noise due to the resistance of air flow, the failure in the simple outer appearance design due to the protrusions of vane holes into which vane rotary shafts of the vanes are inserted and connection rods operated cooperatively with a set of rotary arms of each vane from the exterior of the casing, and high manufacturing cost, and the like.

Technical Solution

To accomplish the above-mentioned objects, according to the present invention, there is provided a damper-integrated blower having improved airtightness having a blower fan embedded in a shaft center of a suction port formed on the side peripheral surface thereof and an exhaust port having a fixing frame, the damper-integrated blower characterized in that a blower casing a on which the suction port is formed and a blower casing b located at the opposite side to the blower casing b, so that the outer periphery of the blower casing a and the outer periphery of the blower casing b are fastened to each other by means of a plurality of casing assembling protruding pieces; a vane stopper protrusion is formed at the center of the bottom surface of the exhaust port of the assembled blower, and a vane contact housing part is formed above the exhaust port, while having the same size as the exhaust port; damper motor screw fixing parts are formed integrally with the outer upper surface of the vane contact housing part adjacent to the exhaust port of the blower casing a on which the suction port is formed and on the surface adjacent to the rear side of the upper side of the fixing frame of the exhaust port; a damper motor shaft hole is bored in the outer peripheral surface of the casing of the suction port of a damper motor shaft hole protrusion part which is integrally formed on the outer upper side of the vane contact housing part adjacent to the damper motor screw fixing parts of the blower casing a; a vane rotation shaft protrudes from the inner surface of a damper motor shaft hole protrusion part of the blower casing b facing the damper motor shaft hole protrusion part of the blower casing a; an eccentric damper motor shaft of a damper motor is introduced into the damper motor shaft hole of the blower casing a so as to connect damper motor fixing brackets facing the damper motor shaft hole with the blower casing a; a vane, which is made of fluorocarbon resin having a shape of a plate as a single member for opening and closing the exhaust port, is connected to the damper motor shaft and the vane rotation shaft located on the inner surface of the damper motor shaft hole protrusion part; and a gasket, which is made of a rubber material, is coupled to the four edges of the vane, thus providing a vane module having the vane and the gasket assembled integrally with each other, whereby the damper-integrated blower can be applied to a compact and slim type heat recovery ventilator having small installation space on a window or a window frame, thus reducing manufacturing cost, providing simple outer appearance, and being usefully applied to all kinds of ventilators or blowers for indoor and outdoor air ventilation.

Advantageous Effects

According to the present invention, the damper-integrated blower having improved airtightness is configured wherein the vane module as a single plate is mounted integrally with the exhaust port, unlike the conventional practice wherein a plurality of vanes laid on each other are operated cooperatively with each other, thus removing the reduction of wind pressure and the generation of noise caused by the vanes during the outdoor air is sucked or the indoor air is exhausted.

In case of conventional blowers, further, a rotary arm, a connection rod hinge shaft, and a connection rod having a connection rod hinge hole, which are fitted cooperatively to each other, are mounted on the exterior of the casing, but the damper-integrated blower according to the present invention has only the damper motor mounted on the exterior thereof, thus making the blower compact and simple in configuration.

Accordingly, the damper-integrated blower according to the present invention is useful in the application to heat recovery ventilators for windows or window frames having small installation spaces and further applicable to all kinds of blowers that perform a ventilating operation through which fresh outdoor air is moved into indoor air, while keeping the heat energy of the indoor air, so that upon the application, the number of parts of the blower can be remarkably reduced to save the manufacturing cost.

BEST MODE FOR INVENTION

Hereinafter, an explanation on a damper-integrated blower having improved airtightness according to the present invention will be in detail given with reference to the attached drawing.

Figure 1:
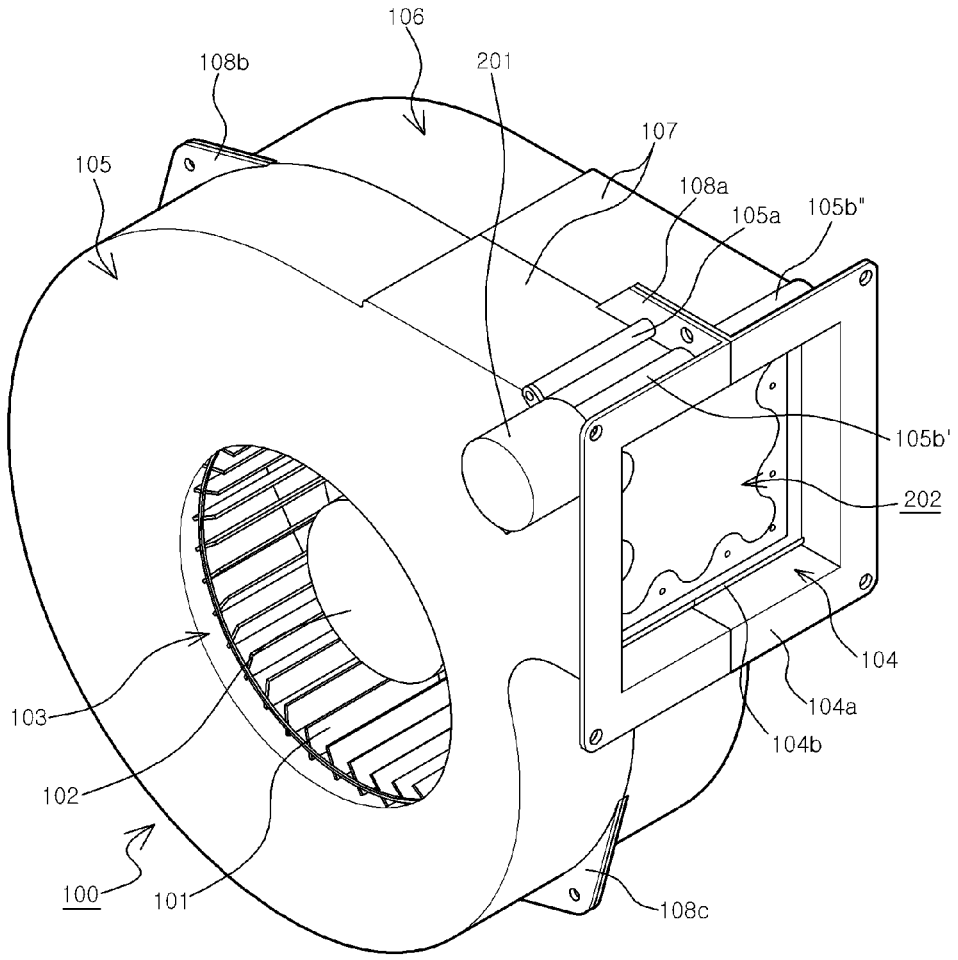
FIG. 1 is a perspective view showing the assembled state of a damper-integrated blower having improved airtightness according to the present invention.
Figure 2:
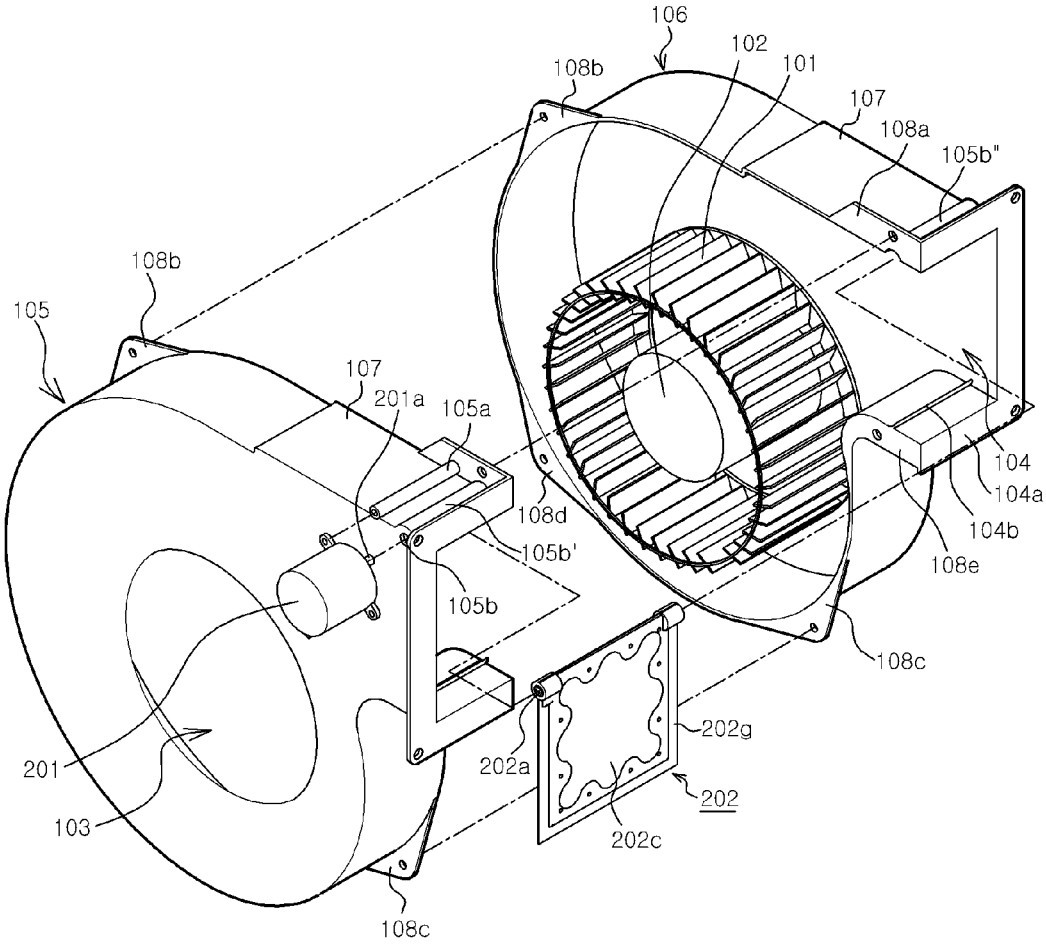
FIG. 2 is an exploded perspective view showing the assembled state of the main parts of the damper-integrated blower according to the present invention.
Figure 3:
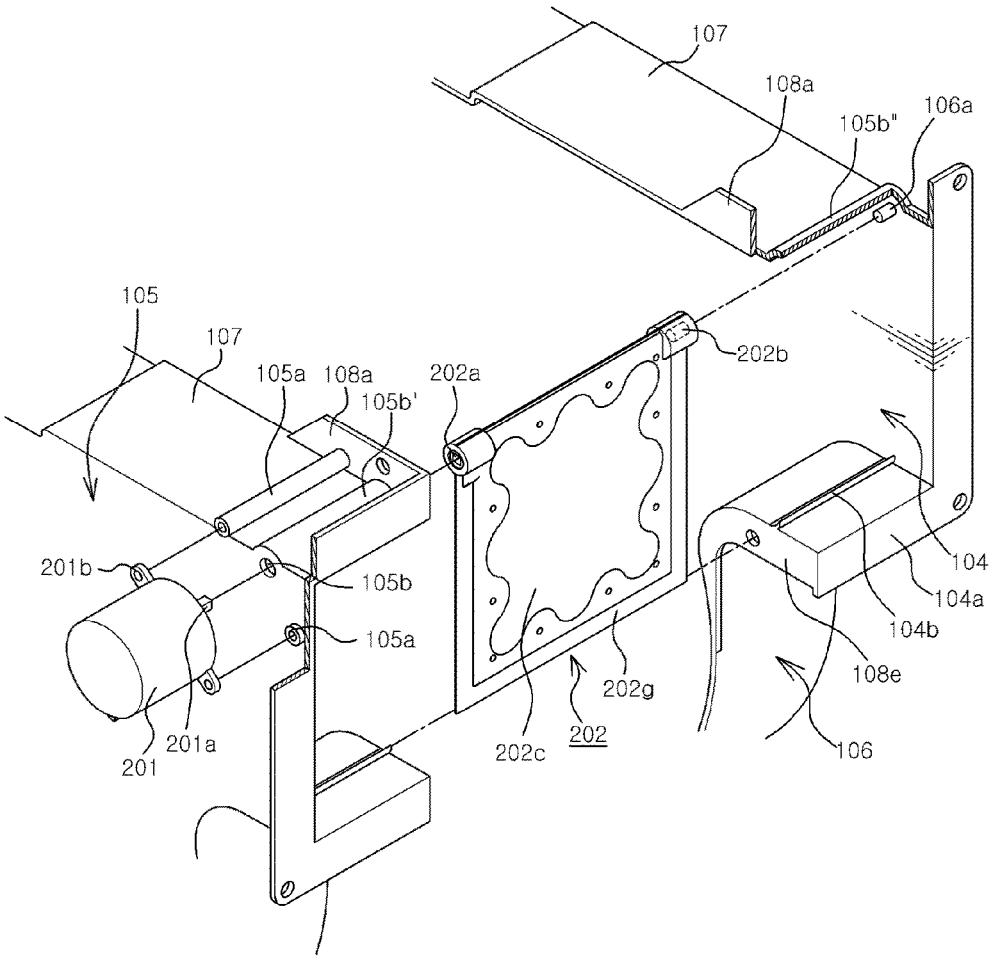
FIG. 3 is an exploded perspective view showing partially cut-off main parts of the damper-integrated blower according to the present invention.
Figure 4:
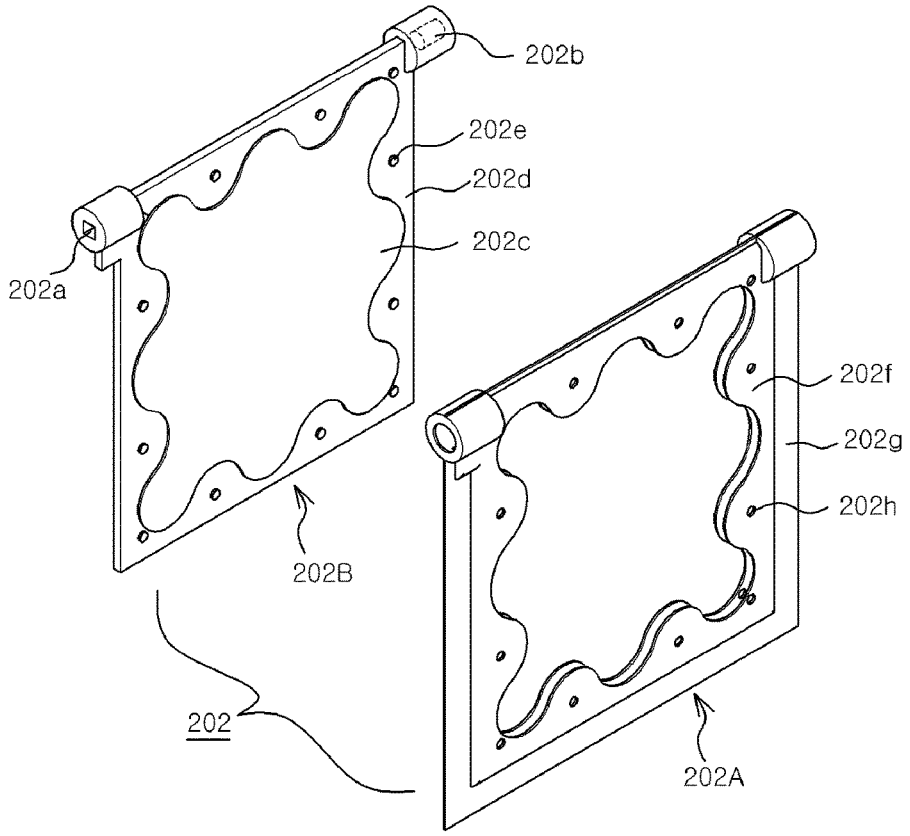
FIG. 4 is a separate perspective view showing the assembled state of a vane module as a main part of the damper-integrated blower according to the present invention.

FIG. 1 is a perspective view showing the assembled state of a damper-integrated blower having improved airtightness according to the present invention, FIG. 2 is an exploded perspective view showing the assembled state of the main parts of the damper-integrated blower according to the present invention, FIG. 3 is an exploded perspective view showing partially cut-off main parts of the damper-integrated blower according to the present invention, and FIG. 4 is a separate perspective view showing the assembled state of a vane module as a main part of the damper-integrated blower according to the present invention.

According to the present invention, a damper-integrated blower 100 includes a blower fan 101 embedded in a shaft center of a suction port 103 formed on the side peripheral surface thereof and an exhaust port 104 having a fixing frame 104*a*.

The blower 100 according to the present invention has a blower casing a 105 on which the suction port 103 is formed and a blower casing b 106 located at the opposite side to the blower casing b 105, so that the outer periphery of the blower casing a 105 and the outer periphery of the blower casing b 106 are fastened to each other by means of a plurality of casing assembling protruding pieces 108*a*, 108*b*, 108*c*, 108*d*, and 108*e*.

A vane stopper protrusion 104*b* is formed at the center of the bottom surface of the exhaust port 104 of the assembled blower 100, and a vane contact housing part 107 is formed above the exhaust port 104, while having the same size as the exhaust port 104.

Damper motor screw fixing parts 105*a* are formed integrally with the outer upper surface of the vane contact housing part 107 adjacent to the exhaust port 104 of the blower casing a 105 on which the suction port 103 is formed and on the surface adjacent to the rear side of the upper side of the fixing frame 104*a* of the exhaust port 104.

A damper motor shaft hole 105*b* is bored in the outer peripheral surface of the casing of the suction port 103 of a damper motor shaft hole protrusion part 105*b*' which is integrally formed on the outer upper side of the vane contact housing part 107 adjacent to the damper motor screw fixing parts 105*a* of the blower casing a 105.

A vane rotation shaft 106*a* a protrudes from the inner surface of a damper motor shaft hole protrusion part 105*b*" of the blower casing b 106 facing the damper motor shaft hole protrusion part 105*b*' of the blower casing a 105.

An eccentric damper motor shaft 201*a* of a damper motor 201 is introduced into the damper motor shaft hole 105*b* of the blower casing a 105 so as to connect damper motor fixing brackets 210*b* facing the damper motor shaft hole 105*b* with the blower casing a 105.

A vane 202B, which is made of fluorocarbon resin having a shape of a plate as a single member for opening and closing the exhaust port 104, is connected to the damper motor shaft 201*a* and the vane rotation shaft 106*a* located on the inner surface of the damper motor shaft hole protrusion part 105*b*", and a gasket 202A, which is made of a rubber material, is coupled to the four edges of the vane 202B, thus providing a vane module 202 having the vane 202B and the gasket 202A assembled integrally with each other.

The vane 202B includes: a square key hole 202*a* formed on one end of a rod formed on both ends of the upper side edge thereof; a rotary shaft hole 202*b* formed on the other end of the rod thereof; a rounded gasket assembling part 202*d* having a plurality of gasket assembling protrusions 202*e* formed thereon; and a vane protrusion 202*c* formed stepped higher than the gasket assembling part 202*d* from the inner sides of the four edges of the gasket assembling part 202*d*, so that the four edges of the vane protrusion 202*c* are assembled with the gasket 202A.

The gasket 202A includes: a pocket-shaped gasket compressing part 202*f* formed on the four edges thereof; a plurality of gasket assembling holes 202*h* formed on the gasket compressing part 202*f* in such a manner as to be coupled to the gasket assembling protrusions 202*e* formed on the gasket assembling part 202*d* formed on the four edges of the vane 202B; and a sheet-shaped wind shielding frame 202*g* formed along the four outer edges of the gasket compressing part 202*f*.

Figure 5:
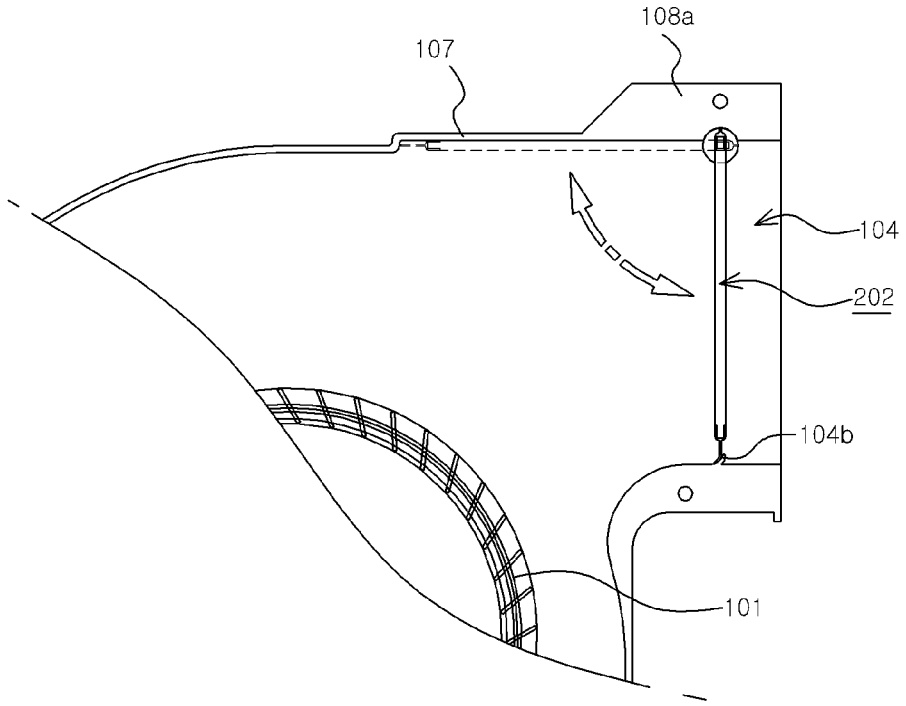
FIG. 5 is a sectional view showing the cut-off state of the damper when blowing stops and the open state of the damper while the blowing is being conducted.

FIG. 5 is a sectional view showing the cut-off state of the damper when blowing stops and the open state of the damper while the blowing is being conducted. Referring to FIG. 5, an explanation on the airtightness improving operation of the damper-integrated blower according to the present invention will be given below.

The vane module 202 has a shape of a plate as a single member connected to the damper motor shaft 201*a* and the vane rotation shaft 106*a* located on the inner surface of the damper motor shaft hole protrusion part 105*b*' within the exhaust port 104 of the blower 100, so as to open and close the exhaust port 104, and at this time, if the blower fan 101 stops, the damper motor 201 operates to move the damper motor shaft 201*a* in a left direction in the drawing to allow the vane module 202 to be rotated by 90° in a counterclockwise direction by means of the vane rotary shaft 106*a* and the damper motor shaft 201*a* fitted to the square key hole 202*a*. Accordingly, the vane module 202 comes into close contact with the vane stopper protrusion 104*b* formed at the center of the bottom surface of the exhaust port 104, so that external air is not introduced into the exhaust port 105 by means of the gasket 202A having the wind shielding frame 202*g* formed on the four edges thereof, thereby improving the airtightness.

By the way, the damper motor 201 which is adapted to open and close the vane module 202 is a small-sized stepping motor, and if main power is applied to the damper motor 201, accordingly, the damper motor 201 is kept closed, without being open by means of wind pressure of the blower fan in the state where the exhaust port is open and external physical pressing or external wind in the state where the exhaust port is closed.

On the other hand, if the blower fan 101 operates to perform blowing, the vane module 202 which has closed the exhaust port 104 is rotated by 90° in a clockwise direction by means of the reverse rotation of the damper motor 201 and thus comes into close contact with the interior of the vane contact housing part 107, thus preventing the interference in the flow of the air discharged to the exhaust port 104. Accordingly, the problems occurring in the conventional blower wherein vanes are laid on each other and installed on the exhaust port, that is, the reduction of the wind pressure by means of the vanes and the generation of noise are completely solved.

The damper-integrated blower having improved airtightness according to the present invention is configured wherein the vane module is mounted integrally with the exhaust port, and accordingly, the configuration of the present invention is more compact than the conventional configuration wherein the damper is separately mounted on the blower casing performing the suction of outdoor air and the exhaust of indoor air.

According to the present invention, further, the blower casing a 105 and the blower casing b 106 of the blower 100 are formed integrally with each other, and accordingly, the vane module 202 can be applied to all kinds of blowers having two separated casings, that is, a suction port side casing and a casing located at the opposite to the suction port side casing.

In the conventional blower, particularly, a rotary arm, a connection rod hinge shaft, and a connection rod having a connection rod hinge hole, which are fitted cooperatively to each other, are mounted on the exterior of the casing, but the damper-integrated blower 100 according to the present invention has only the damper motor 201 mounted on the exterior thereof, thus being applicable to a heat recovery ventilator for a window or window frame having small installation space.

Further, if the damper-integrated blower 100 according to the present invention is applied to all kinds of blowers that perform a ventilating operation through which fresh outdoor air is moved into indoor air, while keeping the heat energy of the indoor air, the number of parts of the blower can be remarkably reduced to save the manufacturing cost.

[Explanation of Reference Numerals]

100: blower 101: blower fan
102: fan motor 103: suction port
104: exhaust port 104a: fixing frame
104b: vane stopper protrusion
105: blower casing a 105a: damper motor screw fixing part
105b: damper motor shaft hole 105b'; 105b": damper motor shaft hole protrusion part
106: blower casing b 107: vane contact housing part
108a, 108b, 108c, 108d, 108e: casing assembling protruding pieces
201: damper motor 201a: damper motor shaft
201b: damper motor fixing bracket
202: vane module 202A: gasket
202B: vane
202a: square key hole 202b: rotary shaft hole
202c: vane protrusion 202d: gasket assembling part
202e: gasket assembling protrusion 202f: gasket compressing part
202g: wind shielding frame
202h: gasket assembling hole

The invention claimed is:

1. A damper-integrated blower comprising:

a blower fan embedded in a shaft center of a suction port formed on a side peripheral surface thereof;

an exhaust port having a fixing frame;

a first blower casing on which the suction port is formed;

a second blower casing located at an opposite side to the first blower casing, so that an outer periphery of the first blower casing and an outer periphery of the second blower casing are fastened to each other by means of a plurality of casing assembling protruding pieces;

a vane stopper protrusion formed at a center of a bottom surface of the exhaust port;

a vane contact housing part formed above the exhaust port and having a same size as the exhaust port in an axial direction;

damper motor screw fixing parts formed integrally with an outer upper surface of the vane contact housing part adjacent to the exhaust port of the first blower casing on which the suction port is formed and on a surface adjacent to a rear upper side of the fixing frame of the exhaust port;

a damper motor shaft hole bored in an outer peripheral surface of a first damper motor shaft hole protrusion part which is integrally formed on the outer upper surface of the vane contact housing part adjacent to the damper motor screw fixing parts of the first blower casing;

a vane rotation shaft protrudes from an inner surface of a second damper motor shaft hole protrusion part of the second blower casing facing the first damper motor shaft hole protrusion part of the first blower casing;

an eccentric damper motor shaft of a damper motor introduced into the damper motor shaft hole of the first blower casing so as to connect a plurality of damper motor fixing brackets facing the damper motor shaft hole with the first blower casing;

a vane, which is made of fluorocarbon resin, having a shape of a plate as a single member for opening and closing the exhaust port and connected to the eccentric damper motor shaft and the vane rotation shaft located on the inner surface of the second damper motor shaft hole protrusion part; and a gasket, which is made of a rubber material, coupled to four edges of the vane, thus providing a vane module having the vane and the gasket assembled integrally with each other.

2. The damper-integrated blower according to claim 1, wherein the vane comprises:

a square key hole formed on one end of a rod formed on both ends of an upper side edge of the vane;

a rotary shaft hole formed on the other end of the rod;

a rounded gasket assembling part having a plurality of gasket assembling protrusions formed thereon; and a vane protrusion formed stepped higher than the rounded gasket assembling part from inner sides of four edges of the rounded gasket assembling part so that four edges of the vane protrusion are assembled with the gasket.

3. The damper-integrated blower according to claim 2, wherein the gasket comprises:

a pocket-shaped gasket compressing part formed on four edges of the gasket;

a plurality of gasket assembling holes formed on the gasket compressing part in such a manner as to be coupled to the plurality of gasket assembling protrusions formed on the rounded gasket assembling part formed on the four edges of the vane; and a sheet-shaped wind shielding frame formed along four outer edges of the gasket compressing part.

* * * * *